US011135500B1

(12) United States Patent
Campbell et al.

(10) Patent No.: US 11,135,500 B1
(45) Date of Patent: Oct. 5, 2021

(54) DEVICE FOR AUTOMATIC SENSING OF MADE AND MISSED SPORTING ATTEMPTS

(71) Applicant: Airborne Athletics, Inc., Bloomington, MN (US)

(72) Inventors: Doug Campbell, Loretto, MN (US); Adam Pan, Elko New Market, MN (US); April L. J. Seifert, Minnetonka, MN (US)

(73) Assignee: Airborne Athletics, Inc., Bloomington, MN (US)

( * ) Notice: Subject to any disclaimer, the term of this patent is extended or adjusted under 35 U.S.C. 154(b) by 0 days.

(21) Appl. No.: 16/567,648

(22) Filed: Sep. 11, 2019

(51) Int. Cl.
*A63B 63/08* (2006.01)
*A63B 71/06* (2006.01)

(52) U.S. Cl.
CPC ..... *A63B 71/0605* (2013.01); *A63B 63/083* (2013.01); *A63B 71/0622* (2013.01); *A63B 2071/0694* (2013.01); *A63B 2220/17* (2013.01); *A63B 2220/40* (2013.01); *A63B 2220/833* (2013.01); *A63B 2225/50* (2013.01)

(58) Field of Classification Search
CPC ..... A63B 71/0605; A63B 71/0622; A63B 63/083; A63B 2071/0694; A63B 2220/17; A63B 2220/40; A63B 2220/833; A63B 2225/50; A63B 43/00
USPC ..... 473/450, 451, 447, 448, 476–489, 433
See application file for complete search history.

(56) References Cited

U.S. PATENT DOCUMENTS 1,223,386 A 4/1917 Handelan
2,908,266 A 10/1959 Cooper et al.
3,776,550 A 12/1973 McNabb
3,802,703 A 4/1974 Van Tassel
3,878,828 A 4/1975 Francesco
4,168,695 A 9/1979 Haller et al.
4,262,648 A 4/1981 Wegener et al.
4,269,163 A 5/1981 Feith
4,337,049 A 6/1982 Connelly
4,471,746 A 9/1984 Ando
4,517,953 A 5/1985 Osaka et al.
(Continued)

FOREIGN PATENT DOCUMENTS

EP 2271414 6/2014
RU 2026104 1/1995
(Continued)

OTHER PUBLICATIONS

Vorelco, The Sniper Basketball Training System, URL <https://www.youtube.com/watch?v=X9SqMy8xdf4, Uploaded on Jul. 5, 2008>.

*Primary Examiner* — Mitra Aryanpour
(74) *Attorney, Agent, or Firm* — Fish & Richardson P.C.

(57) ABSTRACT

A basketball shot counter includes a mounting shaped and sized to connect the basketball shot counter to a portion of a basketball goal having a basketball hoop; a vibration sensor; a processor in data communication with the vibration sensor, wherein the processor is configured to receive, from the vibration sensor, a datastream of vibration sensor readings; determine, from the datastream of vibration sensor readings, that a first basketball shot was attempted without successfully going through the basketball hoop; and determine, from the datastream of vibration sensor readings, that a second basketball shot was attempted and successfully went through the basketball hoop.

22 Claims, 11 Drawing Sheets

(56) References Cited

U.S. PATENT DOCUMENTS 4,579,340 A * 4/1986 Jenkins ..... A63B 63/083 473/436
4,667,957 A 5/1987 Joseph
4,678,189 A * 7/1987 Koss ..... A63B 47/02 473/436
4,714,248 A * 12/1987 Koss ..... A63B 47/02 473/436
4,747,149 A 5/1988 Juhl
4,913,431 A 4/1990 Jakobs
4,915,384 A 4/1990 Bear
4,936,577 A 6/1990 Kington et al.
4,940,231 A 7/1990 Ehler
4,955,605 A 9/1990 Goldfarb
5,016,875 A 5/1991 Joseph
5,062,641 A * 11/1991 Poillon ..... A63B 24/0021 473/155
5,125,651 A 6/1992 Keeling et al.
5,183,253 A 2/1993 Grimaldi et al.
5,312,099 A 5/1994 Oliver, Sr.
5,342,041 A * 8/1994 Agulnek ..... A63B 24/0003 473/447
5,365,427 A * 11/1994 Soignet ..... A63B 24/0021 473/448
5,393,049 A 2/1995 Nelson
5,409,211 A 4/1995 Adamek
5,417,196 A 5/1995 Morrison et al.
5,418,517 A * 5/1995 Matherne ..... A63B 24/0021 473/480
5,540,428 A 6/1996 Joseph
5,601,284 A 2/1997 Blackwell et al.
5,647,747 A 7/1997 Macri et al.
5,676,120 A 10/1997 Joseph
5,681,230 A 10/1997 Krings
5,746,668 A 5/1998 Ochs
5,768,151 A * 6/1998 Lowy ..... A63B 24/0021 463/2
5,771,018 A 6/1998 Kennedy
5,776,018 A * 7/1998 Simpson ..... A63B 24/0021 473/433
5,813,926 A 9/1998 Vance
5,842,699 A * 12/1998 Mirando ..... A63B 63/06 473/480
5,980,399 A 11/1999 Campbell et al.
6,224,503 B1 5/2001 Joseph
6,241,628 B1 * 6/2001 Jenkins ..... A63B 69/0071 473/436
6,302,811 B1 10/2001 Topham
6,389,368 B1 * 5/2002 Hampton ..... A63B 24/0084 473/479
6,458,049 B2 10/2002 Bush
6,461,256 B1 10/2002 Popeck
6,496,812 B1 12/2002 Campaigne et al.
6,659,893 B1 12/2003 Campbell et al.
6,707,487 B1 3/2004 Aman et al.
6,731,316 B2 5/2004 Herigstad et al.
6,746,397 B2 6/2004 Lee et al.
7,094,164 B2 * 8/2006 Marty ..... A63B 71/0605 473/416
7,247,105 B2 * 7/2007 Huntsberger ..... A63B 24/0021 473/433
7,288,034 B2 10/2007 Woodard et al.
7,850,552 B2 12/2010 Marty et al.
7,854,669 B2 12/2010 Marty et al.
7,927,237 B2 * 4/2011 Jenkins ..... A63B 69/0071 473/433
7,938,746 B2 * 5/2011 Chipperfield ..... A63B 24/0021 473/434
7,998,004 B2 * 8/2011 Klein ..... A63B 63/00 473/480
8,016,687 B2 9/2011 Martin et al.
8,123,634 B1 2/2012 Lovett
8,147,356 B2 4/2012 Campbell et al.
8,206,246 B2 * 6/2012 Joseph ..... G09B 19/0038 473/433
8,408,982 B2 4/2013 Marty et al.
8,409,024 B2 4/2013 Marty et al.
8,540,560 B2 9/2013 Crowley et al.
8,579,632 B2 11/2013 Crowley
8,617,008 B2 * 12/2013 Marty ..... G06T 7/70 473/447
8,622,832 B2 1/2014 Marty et al.
8,845,460 B1 * 9/2014 Feldstein ..... A63B 47/002 473/433
8,852,030 B2 10/2014 Campbell et al.
8,908,922 B2 * 12/2014 Marty ..... G06T 7/80 382/103
8,948,457 B2 2/2015 Marty et al.
9,010,309 B2 4/2015 Lewis et al.
9,017,188 B2 * 4/2015 Joseph ..... A63B 24/0062 473/433
9,233,292 B2 1/2016 Joseph et al.
9,248,368 B2 2/2016 Stimac
9,265,991 B2 * 2/2016 Hohteri ..... G01S 5/02 463/1
9,283,431 B2 * 3/2016 Marty ..... A63B 69/0071 473/433
9,283,432 B2 3/2016 Marty et al.
9,345,929 B2 5/2016 Marty et al.
9,370,704 B2 6/2016 Marty
9,390,501 B2 7/2016 Marty et al.
9,697,617 B2 7/2017 Marty et al.
9,724,584 B1 8/2017 Campbell et al.
9,734,405 B2 8/2017 Marty et al.
9,808,696 B2 11/2017 Campbell et al.
9,844,704 B2 12/2017 Thurman et al.
9,886,624 B1 2/2018 Marty et al.
9,978,425 B2 5/2018 Kirk et al.
10,004,949 B2 6/2018 Brothers et al.
10,159,888 B2 * 12/2018 Ianni ..... G06Q 10/0639 463/1
10,252,133 B2 4/2019 Campbell et al.
10,518,153 B2 * 12/2019 Joseph ..... A63B 24/0075 473/433
10,537,780 B2 * 1/2020 Joseph ..... A63B 69/0071 473/433
10,675,523 B2 * 6/2020 Joseph ..... A63B 24/0062 473/433
10,695,634 B2 * 6/2020 Cuenin ..... A63B 63/083 473/433
2001/0052472 A1 12/2001 Ikeda et al.
2002/0010032 A1 1/2002 Stiteler
2002/0016236 A1 2/2002 Stearns et al.
2002/0072681 A1 6/2002 Schnali
2002/0147404 A1 10/2002 Kato et al.
2003/0023145 A1 1/2003 Lee et al.
2003/0073518 A1 4/2003 Marty et al.
2004/0092840 A1 5/2004 Nakada
2005/0187036 A1 8/2005 Ziola et al.
2005/0215870 A1 9/2005 Rademaker
2006/0057549 A1 3/2006 Prinzel, III et al.
2006/0138809 A1 6/2006 Joseph
2006/0160639 A1 6/2006 Klein
2007/0021242 A1 * 1/2007 Krickler ..... A63B 69/0002 473/451
2007/0026974 A1 2/2007 Marty et al.
2007/0026975 A1 * 2/2007 Marty ..... A63B 24/0021 473/467
2008/0015061 A1 1/2008 Klein
2008/0200287 A1 8/2008 Marty et al.
2008/0254866 A1 10/2008 Young et al.
2008/0261726 A1 10/2008 Chipperfield
2008/0312010 A1 12/2008 Marty et al.
2009/0047645 A1 2/2009 Dibenedetto et al.
2009/0137347 A1 5/2009 Jenkins et al.
2009/0191988 A1 7/2009 Klein
2009/0270743 A1 10/2009 Dugan et al.
2010/0259412 A1 10/2010 Pagonakis
2010/0261557 A1 10/2010 Joseph et al.
2010/0292033 A1 11/2010 Sarver
2011/0294585 A1 12/2011 Penna et al.

(56) References Cited

U.S. PATENT DOCUMENTS

| | | | |
|---|---|---|---|
| 2012/0115651 | A1 | 5/2012 | Chipperfield |
| 2012/0142454 | A1 | 6/2012 | Campbell et al. |
| 2012/0322587 | A1 | 12/2012 | Duke |
| 2013/0005512 | A1 | 1/2013 | Joseph et al. |
| 2013/0095959 | A1 | 4/2013 | Marty et al. |
| 2013/0130845 | A1 | 5/2013 | Marty et al. |
| 2013/0157786 | A1 | 6/2013 | Joseph et al. |
| 2013/0172058 | A1 | 7/2013 | Marty et al. |
| 2013/0272393 | A1 | 10/2013 | Kirenko |
| 2014/0031703 | A1 | 1/2014 | Rayner et al. |
| 2014/0092253 | A1 | 4/2014 | Marty et al. |
| 2014/0200692 | A1 | 7/2014 | Thurman et al. |
| 2014/0301601 | A1 | 10/2014 | Marty et al. |
| 2015/0248917 | A1 | 9/2015 | Chang et al. |
| 2015/0265897 | A1 | 9/2015 | Gordon et al. |
| 2016/0121193 | A1 | 5/2016 | Marty et al. |
| 2016/0250540 | A1 | 9/2016 | Joseph et al. |
| 2016/0325168 | A1 | 11/2016 | Campbell et al. |
| 2016/0332054 | A1 | 11/2016 | Smith |
| 2017/0072283 | A1* | 3/2017 | Davisson ..... A63B 43/00 463/1 |
| 2017/0161561 | A1 | 6/2017 | Marty et al. |
| 2017/0232298 | A1 | 8/2017 | Joseph et al. |
| 2018/0056124 | A1 | 3/2018 | Marty et al. |
| 2018/0147468 | A1* | 5/2018 | Gordon ..... A63B 24/0062 473/447 |
| 2020/0086194 | A1* | 3/2020 | Gordon ..... A63B 71/0622 473/447 |

FOREIGN PATENT DOCUMENTS

| | | |
|---|---|---|
| WO | WO 95/30872 | 11/1995 |
| WO | WO 95/32033 | 11/1995 |
| WO | WO 2005/062841 | 7/2005 |
| WO | WO 2009/126982 | 10/2009 |

* cited by examiner

DEVICE FOR AUTOMATIC SENSING OF MADE AND MISSED SPORTING ATTEMPTS

TECHNICAL FIELD

This document describes technology for the electronic sensing and classification of shots in a sports activity, such as in basketball for example.

BACKGROUND

A sensor in a device, module, or subsystem detects events or changes in its environment and sends the information to other electronics (e.g., to a processor.) A sensor's sensitivity indicates how much the sensor's output changes when the input quantity being measured changes. For instance, if a thermal sensor changes an electrical signal by 1 Volt when the temperature changes by 1° C., the sensitivity is called 1 Volt/° C.

Sport generally includes competitive physical activity or games, which, through casual or organized participation, aim to use, maintain, or improve physical abilities and skills while providing enjoyment to participants and or spectators. Basketball is a team sport in which two teams, commonly of five players each, opposing one another on a rectangular court, compete with the primary objective of shooting a basketball through a basketball hoop.

SUMMARY

A shot counter system can be used to detect and count shots in a sports activity. In one implementation, a basketball shot counter system includes a mounting shaped and sized to connect the basketball shot counter to a portion of a basketball goal having a basketball hoop; a vibration sensor; a processor in data communication with the vibration sensor, wherein the processor is configured to receive, from the vibration sensor, a datastream of vibration sensor readings; determine, from the datastream of vibration sensor readings, that a first basketball shot was attempted without successfully going through the basketball hoop; and determine, from the datastream of vibration sensor readings, that a second basketball shot was attempted and successfully went through the basketball hoop.

Implementations can include none, one, or many of the following features. The processor is configured to distinguish vibration sensor readings indicative of a made shot from vibration sensor readings indicative of a missed shot. The processor is configured to distinguish vibration sensor readings indicative of a made shot from vibration sensor readings indicative of a missed shot based on a predictive model that is configured to predict whether a shot is made based upon one or more machine-learning trained classifiers and the datastream of vibration sensor readings. The vibration sensor comprises an accelerometer, and wherein the basketball shot counter further comprises a magnetometer and a gyroscope. The datastream comprises a first set of vibration data and a second set of vibration data, wherein the processor is configured to interpret the first set of vibration data as being indicative of a missed shot when the first set of vibration data appears without the second set of vibration data and the processor interprets the first set of vibration data as being indicative of a made shot when the first set of vibration data appears with the second set of vibration data. The basketball shot counter system comprises an impact member in vibrational communication with the vibration sensor, wherein the impact member is sized and configured to be positioned in a ball path under the basketball hoop when the basketball shot counter system is mounted to the basketball goal. The basketball goal further comprises a backboard and a net, and wherein the basketball shot counter is configured to transfer vibration from the basketball goal to the vibration sensor when a basketball impacts the backboard and when the basketball impacts the basketball hoop. A single unit comprises the mounting, the vibration sensor, and the processor. The processor is physically remote from the vibration sensor and the mounting and wherein the processor is a part of a client device.

In one implementation, a sports shot counter includes a mounting shaped and sized to connect the sports shot counter to a portion of a sports goal; a sensor configured to sense an impact; and a processor in data communication with the sensor, wherein the processor is configured to sense and distinguish between made shots and missed shots as a function of sensed impact.

Implementations can include none, one, or many of the following features. The sensor is a vibration sensor configured to sense impact with the sports goal and wherein the processor is configured to sense and distinguish between made shots and missed shots as a function vibration caused by impact with the sports goal. The processor distinguishes between made shots and missed shots according to a predictive model of trained classifiers.

In one implementation, a device for determining made-attempts in a sporting activity, the device comprising: a primary housing; a vibration sensor mechanically coupled to the primary housing and configured to sense vibrations of the primary housing; an impact member in vibrational communication with the primary housing, the impact member comprising a metal spring in a curved tube; a mounting shaped to interface with the goal usable for the sporting activity in order to attach the device to the goal; and a processor configured to: receive, from the vibration sensor, a datastream of sensor readings; identify a set of recent sensor readings; determine, based on the set of recent sensor readings, if an attempt of the sporting activity was made; and responsive to the determination, transmit to a client device a made-message indicating if the attempt was made.

Implementations can include none, one, or many of the following features. The goal is a basketball hoop and the mounting is shaped to connect to the basketball hoop so as to mount the device on the basketball hoop. The device attached to the goal, the impact member is positioned about the goal in an area likely to be impacted by a ball used in a made attempt of the sporting activity. The goal is a basketball hoop and wherein with the device attached to the goal, the impact member is positioned under the hoop. Impact by a basketball with the impact member creates first vibrations in the impact member, and the first vibrations are communicated from the impact member to the primary housing sensed by the vibration sensor. Impact by a basketball with a basketball hoop that is connected to the primary housing creates second vibrations of the primary housing sensed by the vibration sensor. The processor is configured to determine if the attempt of the sporting activity was made based at least in part on the second vibrations. The attempt in the sporting activity was made. The attempt in the sporting activity was not made. To determine, based on the set of recent sensor readings, if an attempt of the sporting activity was made, the processor is configured to: submit the set of recent sensor readings to a made-classifier; receive, from the made-classifier, a made-confidence that measures a likelihood that the set of recent sensor readings correspond to a made attempt in the sporting activity; and compare the made-confidence against a made-threshold value that indicates a minimum likelihood for an attempt to be considered made. To submit the set of recent sensor readings to a made-classifier the processor is configured to: generate, from the set of recent sensor readings, a maximal feature that represents a maximal measure of the vibrations; and generate, from the set of recent sensor readings, an aggregate feature that represents an aggregate measure of the vibrations. The maximal feature is a largest change in acceleration in sequential sensor readings in the set of sequential sensor readings; and wherein the aggregate feature is a summation of every change in acceleration in sequential sensor readings in the set of sequential sensor readings. The vibration sensor is an accelerometer that senses acceleration in an X-direction, acceleration in a Y-direction, and acceleration in a Z-direction. Each sensor reading in the datastream of sensor readings comprises an X-value corresponding to the sensed acceleration in the X-direction, a Y-value corresponding to the sensed acceleration in the Y-direction, and a Z-value corresponding to the sensed acceleration in the Z-direction. The primary housing comprises a rigid plastic material. The mounting comprises one or more magnets shaped to attach to the goal when placed in proximity of the goal, putting the device in vibrational communication with the goal. The device comprises a circuit board that comprises the vibration sensor and the processor. The circuit board further comprises a data interface. The processor is further configured to store the datastream to a computer memory.

DESCRIPTION OF DRAWINGS

Like reference symbols in the various drawings indicate like elements

DETAILED DESCRIPTION

A device can be used for automatic detection of made and/or missed attempts in a sporting activity. For example, a device can be attached to a basketball hoop, and the device can automatically determine if a shot that hits the hoop went through the hoop (i.e. is made) or does not go through the hoop (i.e. is missed.) This device can use an accelerometer to sense vibrations transmitted through the hoop and through the body of the device using an accelerometer. The readings from the accelerometer can be provide to a machine-learning classifier that can classify those readings as indicating the make or indicating the miss. This result can then be stored to computer memory, transmitted to a client device, shown to a user, etc.

Figure 1:
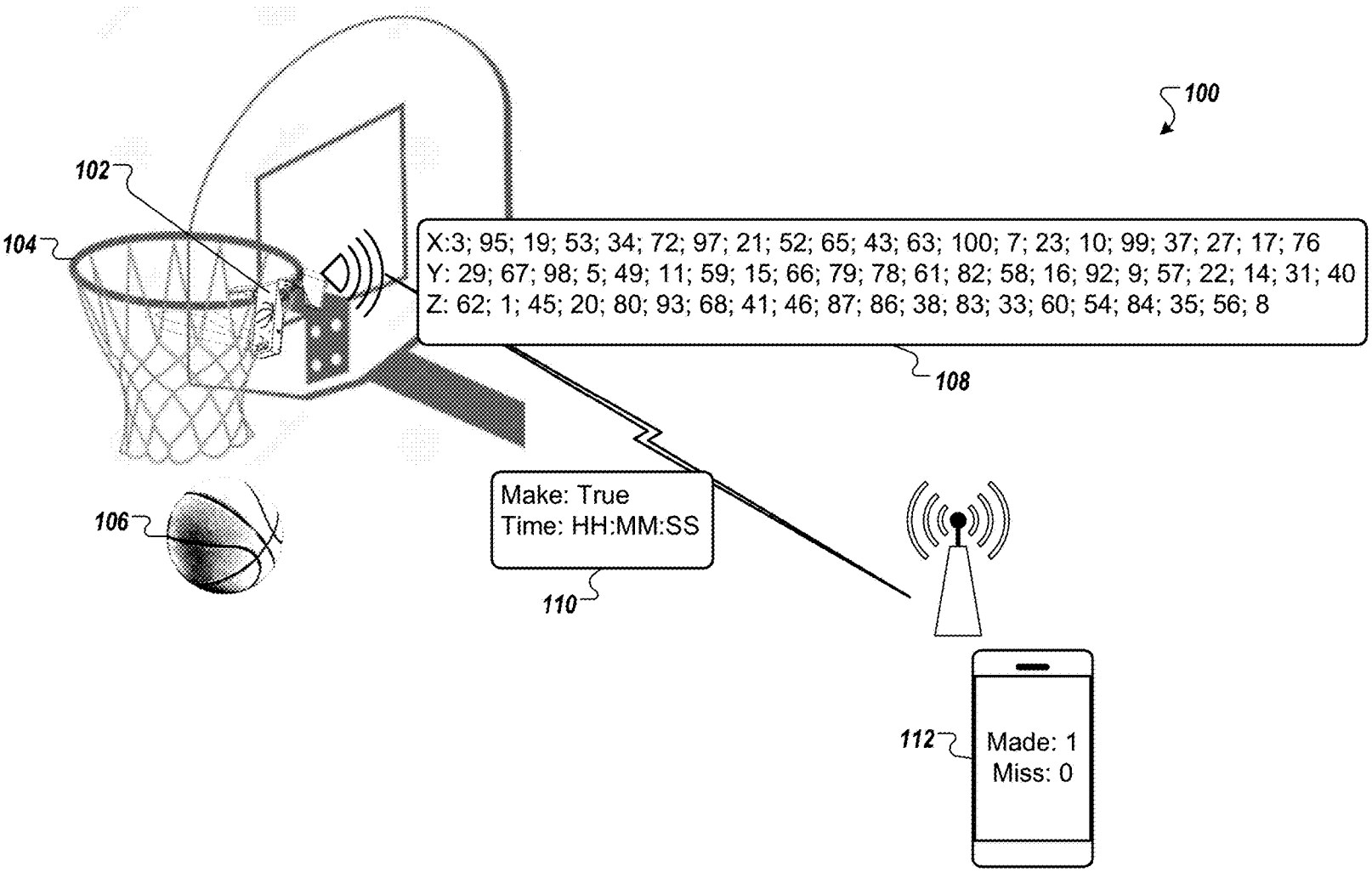
FIG. 1 shows a schematic diagram of a system in which a made-sensing device is used for determining made-attempts in a sporting activity.

FIG. 1 shows a schematic diagram of a system 100 in which a made-sensing device 102 is used for determining made-attempts in a sporting activity. As shown here, the device 102 is attached to a basketball hoop 104. When a basketball 106 is shot at the rim 104, the device 102 senses vibrations and generates vibration data 108. The device 102 can analyze the vibration data 108 to determine if a shot was made or missed, and transmit the result in a message 110 to a client device 112 for display.

In orders to determine makes and misses, the device 102 can use one or more machine-learning trained classifiers that are capable of classifying the data 108 into makes or misses. For example, the device 102 can, on a rolling basis, generate features from the N most recent values in the data 108 and submit those features to the classifier. The classifier can return a confidence value that is a measure of likelihood that the recent data 108 was generated when the ball 106 passed through the hoop 104 (for a make) or did not pass through the hoop 104 (for a miss.)

Figure 2A:
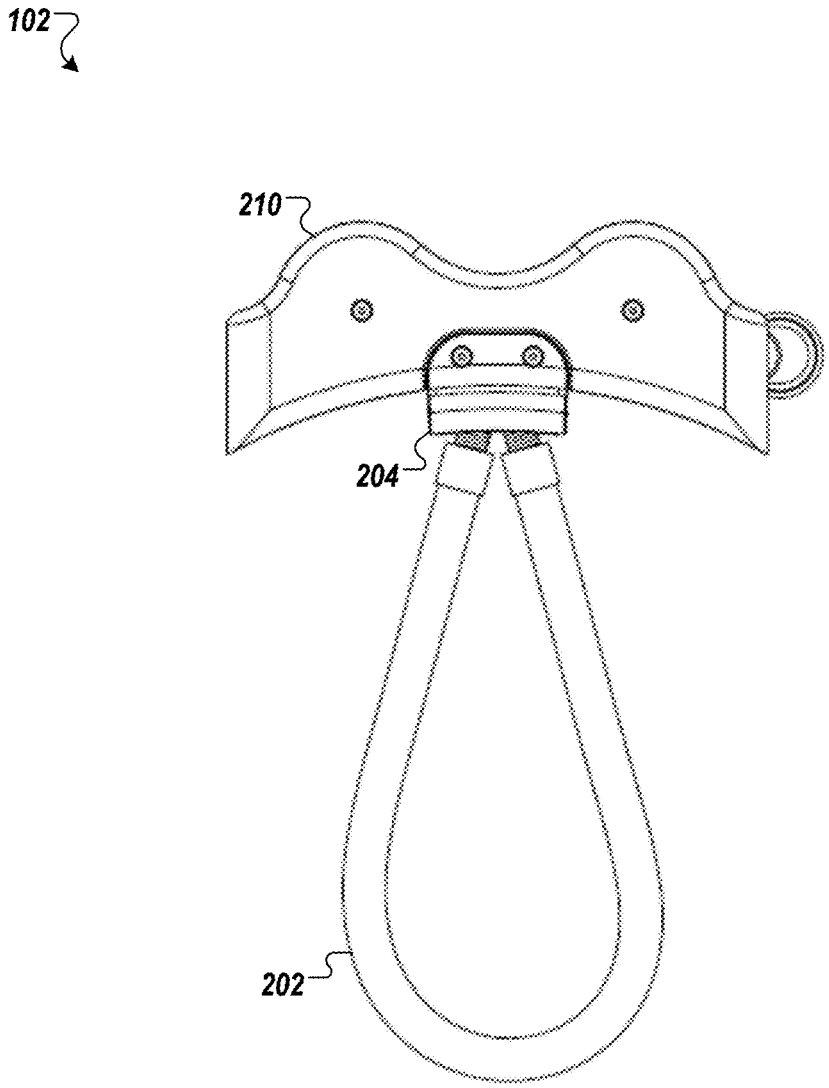
FIGS. 2A-2C show a top, front, and side view of a made-sensing device.
Figure 2B:
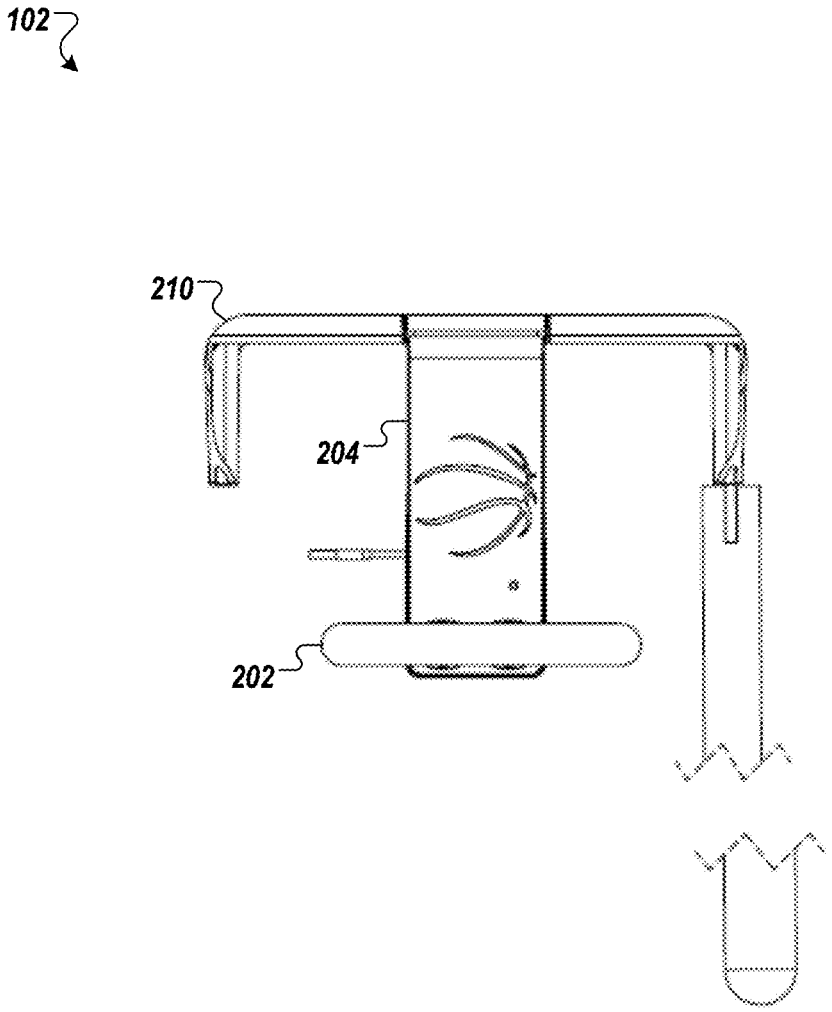
Figure 2C:
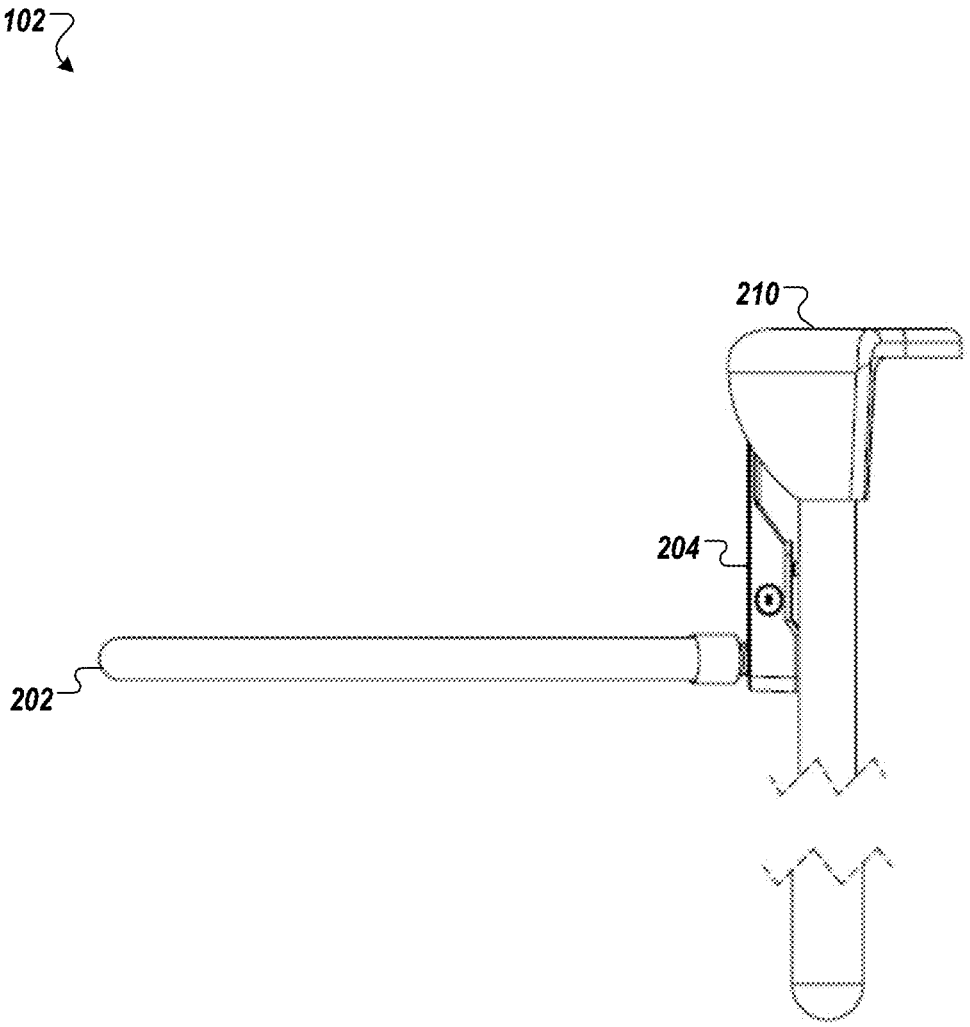
Figure 3:
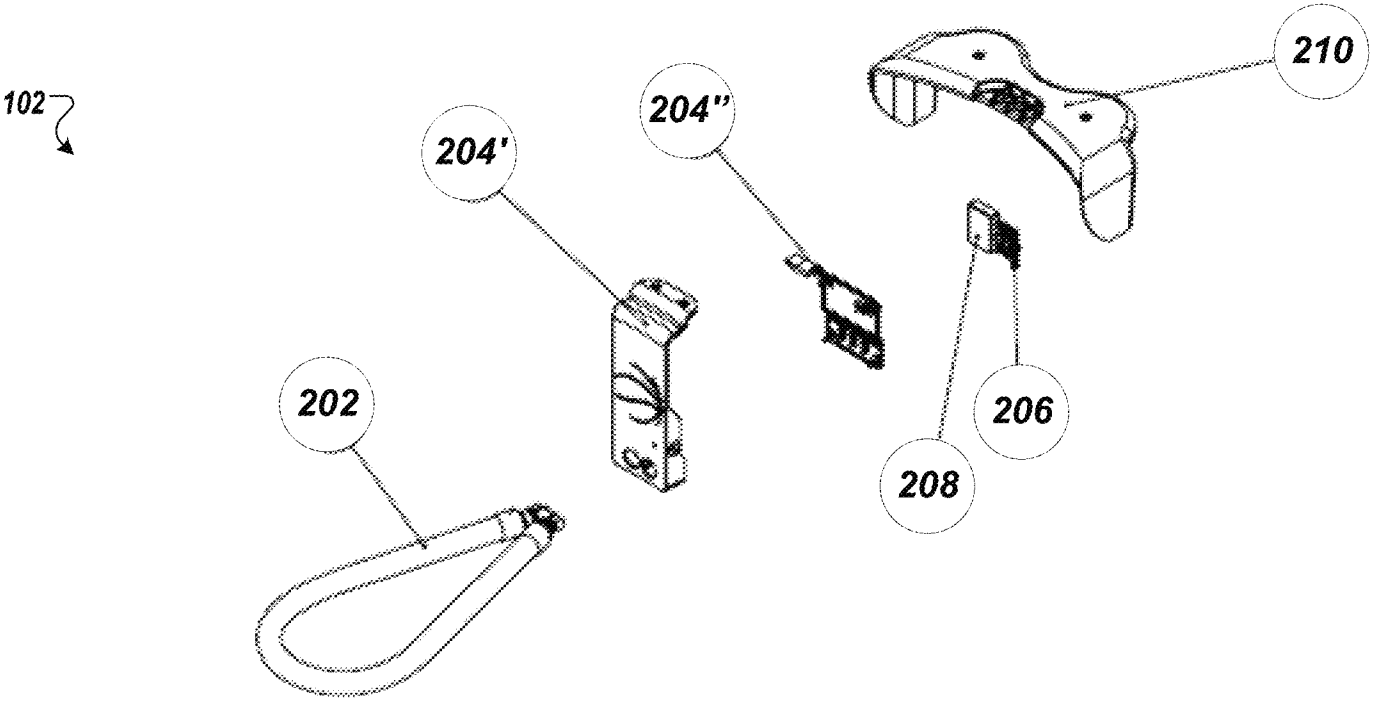
FIG. 3 shows an assembly of subsystems of a made-sensing device.
Figure 4A:
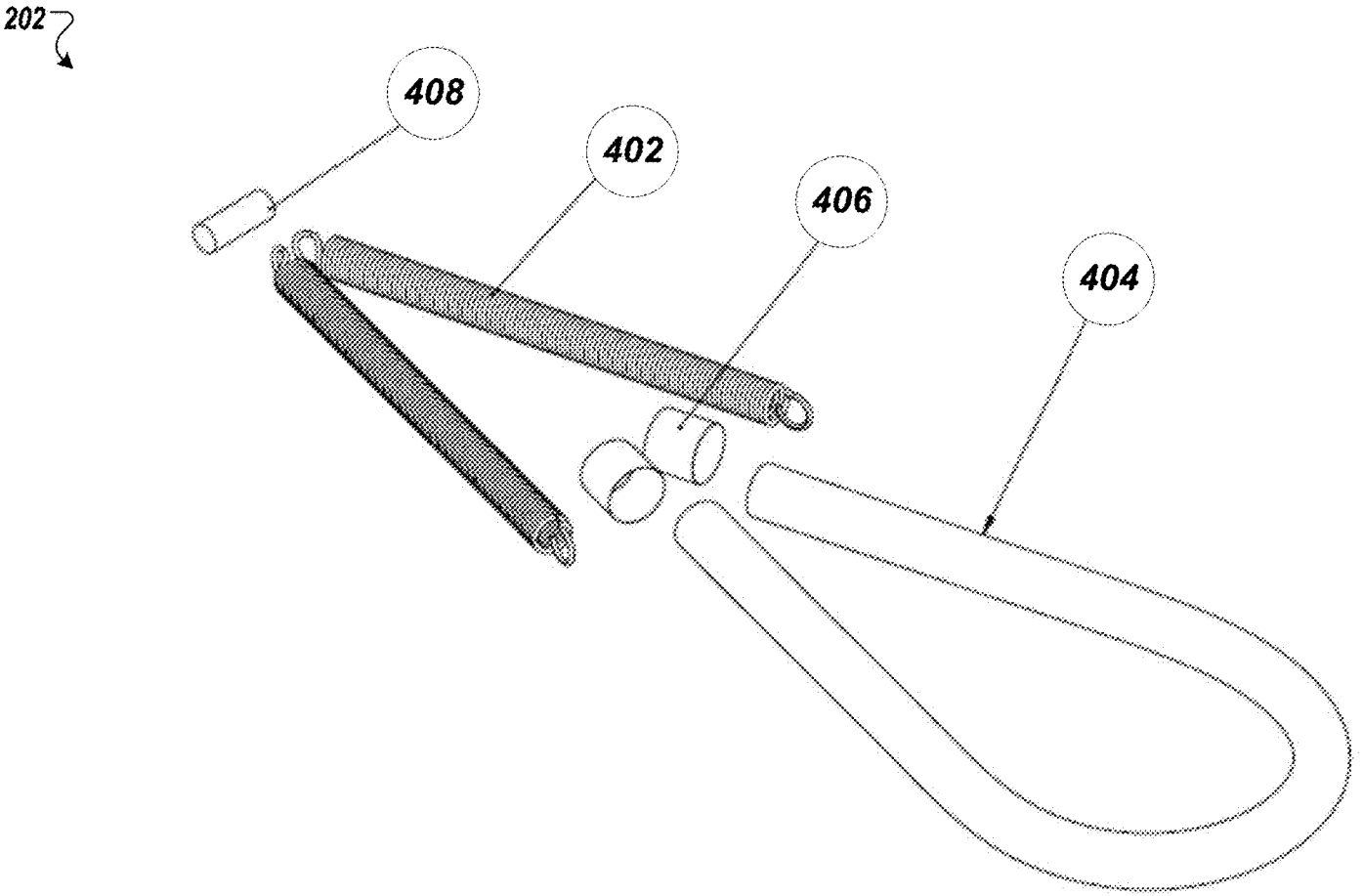
FIGS. 4A-4B show an impact member.
Figure 4B:
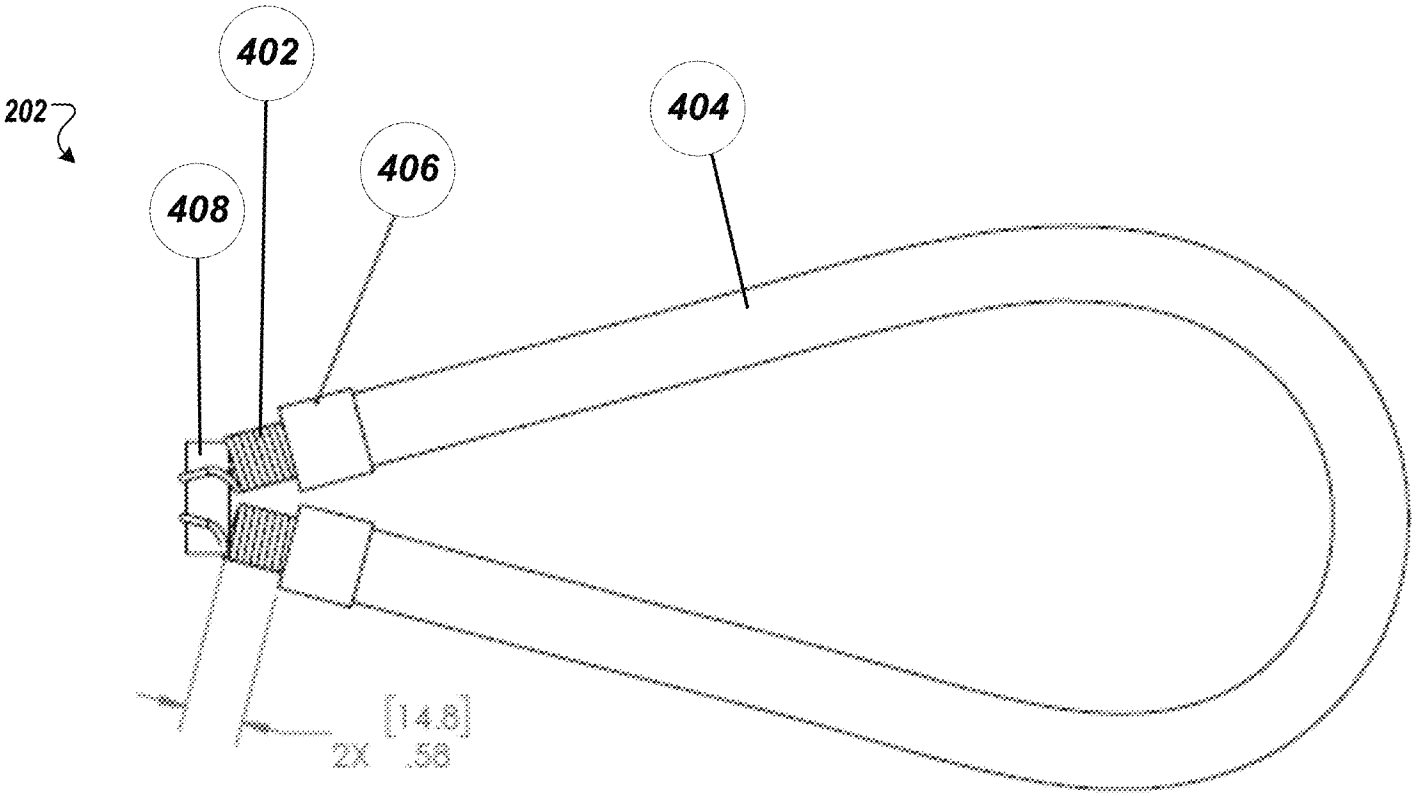

FIGS. 2A-2C show top (FIG. 2A), front (FIG. 2B), and side (FIG. 2C) views of the made-sensing device 102. FIG. 3 shows an assembly of subsystems of the made-sensing device 102. FIGS. 4A-4B show an impact member. The device 102 can include an impact member 202, a primary housing 204, a circuit board 206 with a battery 208, and a mounting 210.

The impact member 202 can be in vibrational communication with the primary housing 204. That is, at least some vibration of the impact member 202 (e.g., from impact with a basketball) can be translated to the primary housing. In this example, the impact member comprises two metal springs 402 positioned in a curved tube 404. The impact member 202 also can include sleeves 406 that are friction-fit over the curved tube 404 to secure the springs 402. The sleeves 406 may be made of, for example, a shrink-fit plastic, an adhesive, etc. A retaining pin 408 can retain the springs 402 and the retaining pin 408 may rigidly mount in the primary housing 204.

The curved tube 404 is made of one or more materials that are rigid enough to hold the springs 402 cantilevered and extending in the horizontal direction under the hoop when the device 102 is mounted on a basketball hoop. As such, the impact member is positioned in the hoop in an area likely to be impacted by a ball used in a made attempt to shoot the ball through the hoop.

The primary housing 204 can attach to the impact member 202 so that the impact member 202 is in vibrational communication with the primary housing 204. For example, the springs 404 may be seated in recesses of the primary housing 204 and a retaining pin 408 may fit into ends of the springs 402 to secure the impact member 202 in the primary housing 204.

In some embodiments, the impact member 202 can be replaced with one or more different impact members. For example, the device 102 can include some other type of projection that is sized, shaped, and configured to extend into a path of a basketball or other sports object to be impacted by the object and impart a vibration to the device 102. Impacting the impact member 202 or another projection can impart a particular vibration to the device 102 such that the device 102 can distinguish that particular vibration (e.g. when a basketball hits the projection) from other vibrations (e.g. when a ball hits a basketball rim but does not go through the basketball hoop).

In some embodiments, the impact member 202 can be omitted and the device 102 can distinguish between made and missed shots based on vibration signals transmitted to the device 102 during the made and missed shots.

The primary housing may 204 may be constructed of two or more parts, shown in FIG. 3 as 204' and 204". These two parts may be secured together by, for example, fasteners such as screws or rivets, adhesive, and/or friction fittings. The primary housing 204 may be made of one or more technologically appropriate materials that include, metal, plastic, or another rigid material that is generally firm enough to transmit vibrations across the primary housing 204.

Figure 6A:
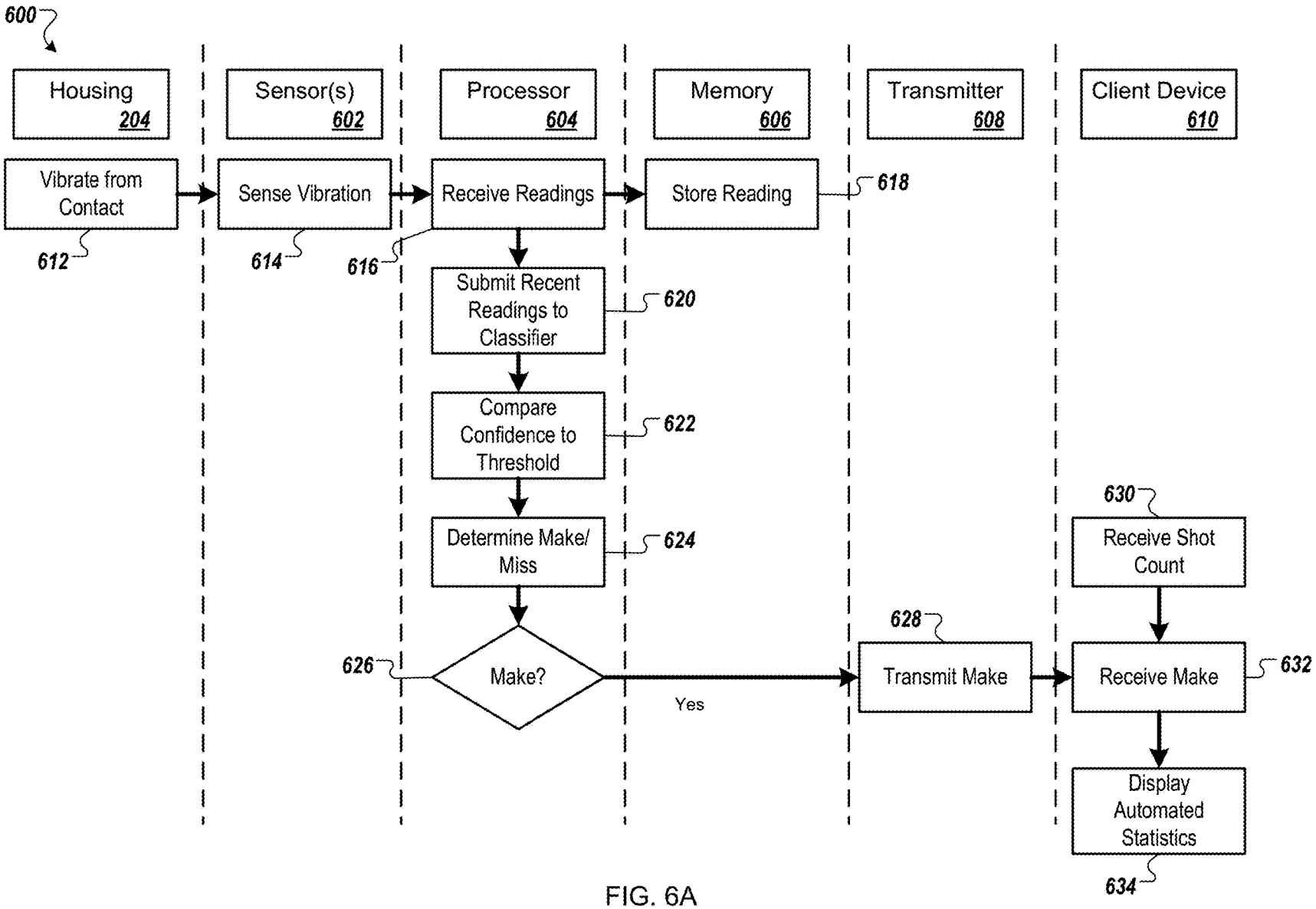
FIGS. 6A and 6B are swimlane diagrams of example processes for determining made-attempts with a made-sensing device.
Figure 6B:
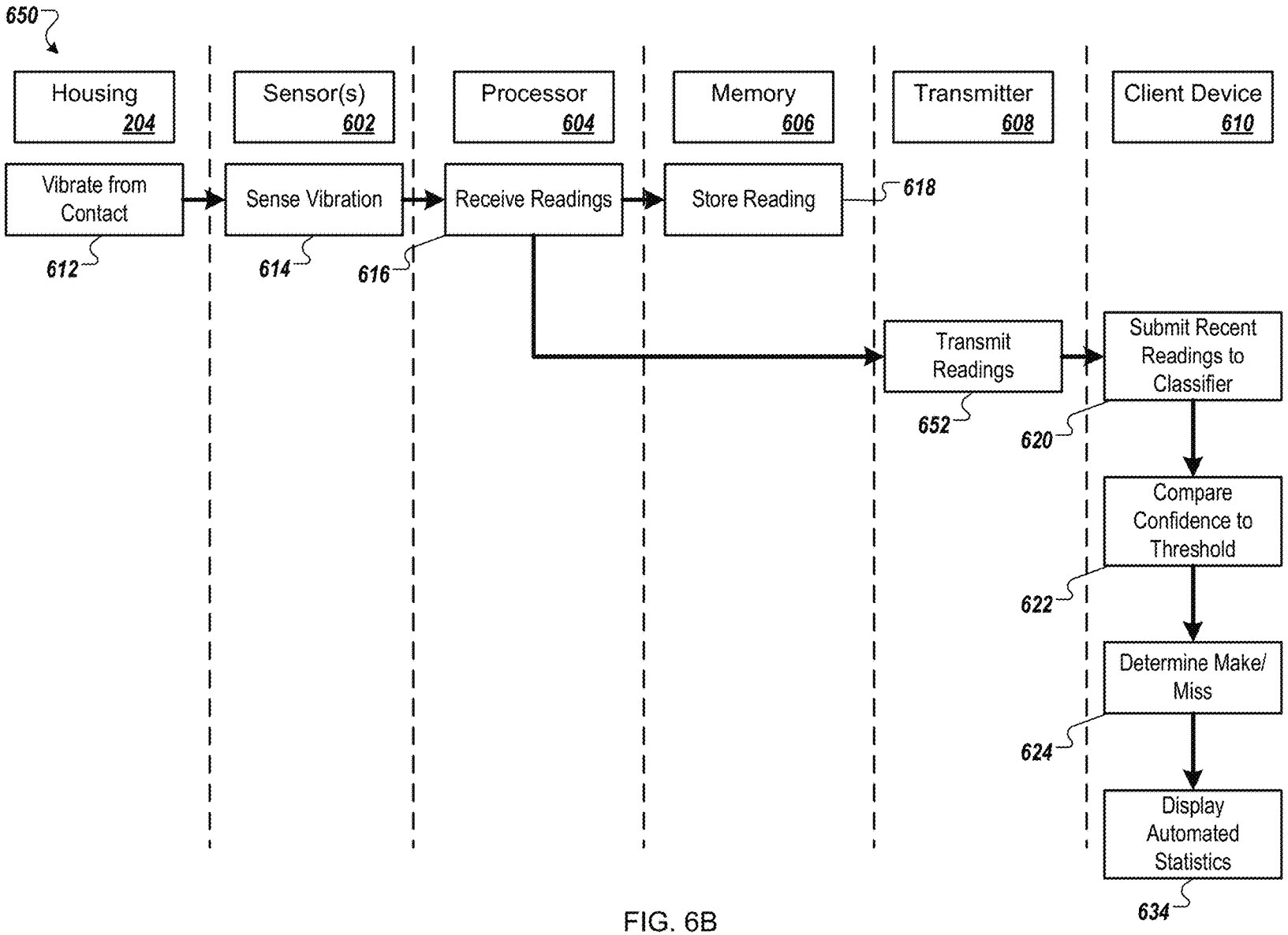
Figure 7:
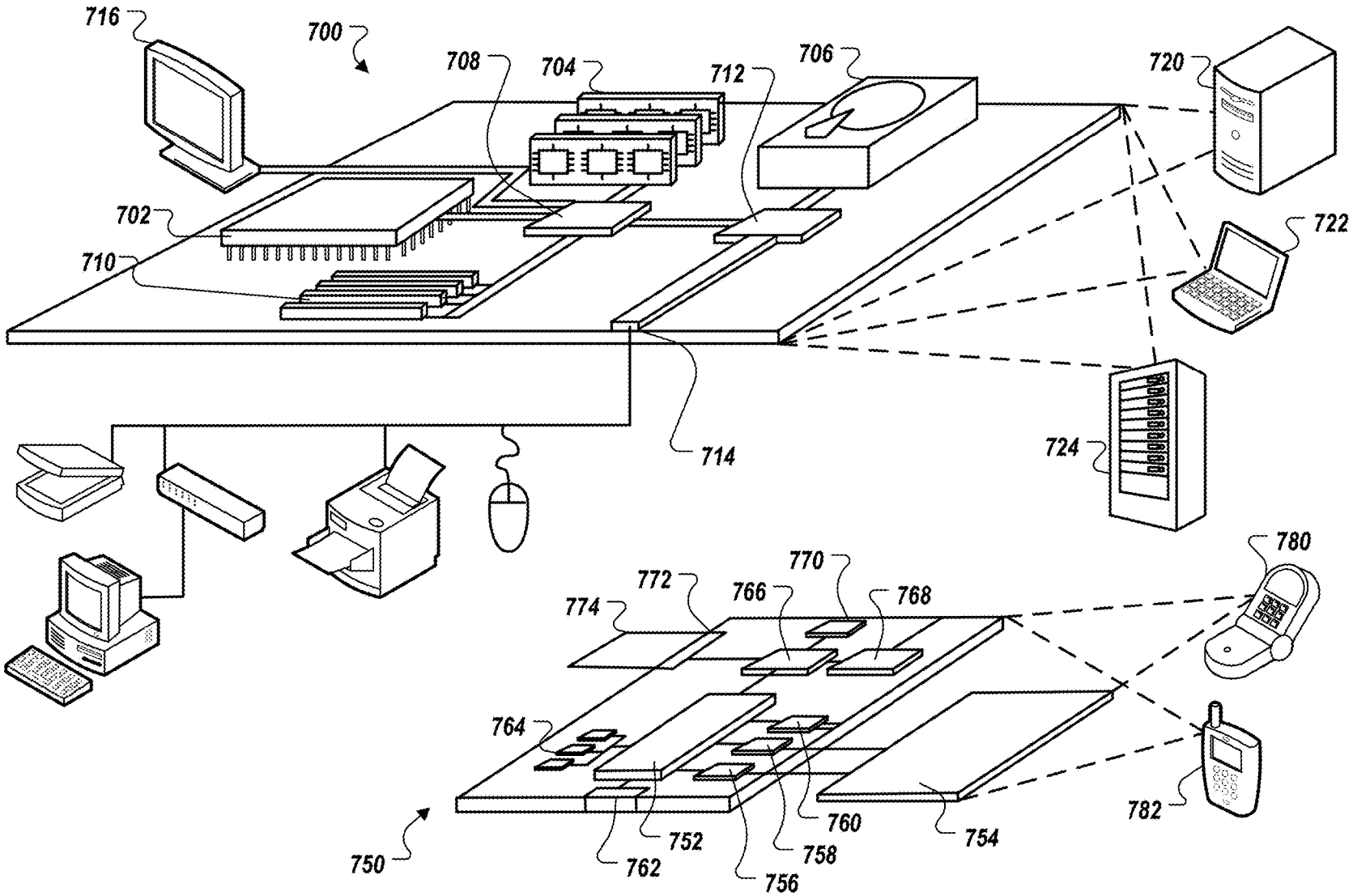
FIG. 7 is a schematic diagram that shows an example of a computing device and a mobile computing device.

A circuit board 206 can include components such as a battery 208, a vibration sensor, a processor, computer memory, data interfaces (e.g., antennae or wired ports,) and printed circuit pathways that transmit current between the various components (a sensor, processor, memory, and other components are shown in FIGS. 6 and 7).

The vibration sensor can include one or more components that operate to sense vibration in their environment (i.e. the primary housing 204) and generate a corresponding datastream of sensor readings based on the vibrations. In general, the sensor readings record the vibrations of the device 102 and/or the primary housing 204. These sensor readings may take the form of, for example, acceleration vectors in XYZ space, absolute locations in XYZ space, or measurements in another coordinate system such as orientation (e.g., using a magnetometer to find magnetic north, a gyroscope to find angular movement.) The datastream may include a reading at every periodic moment in time, for example every $100^{th}$ of a second or every 150 ms. For example, the datastream may be a stream of sensor readings, recorded every 125 ms, each reading including an X-value corresponding to the sensed acceleration in the X-direction, a Y-value corresponding to the sensed acceleration in the Y-direction, and a Z-value corresponding to the sensed acceleration in the Z-direction.

In some embodiments, the device 102 can be operated using a single sensor or single type of sensor, such as using an accelerometer without using a gyroscope or a magnetometer.

The mounting 210 is shaped and sized to interface with a goal that is usable for sporting activities, such as a basketball hoop. As such, the mounting 210 can attach the device 102 to the basketball hoop in order to detect made and missed shots on the hoop. In some cases, the mounting 210 can include one or more magnets shaped to attach to the hoop when the device 210 is placed in proximity of the hoop. With such an attachment, the device 102 is in vibrational communication with the hoop, and vibrations to the hoop, net, or backboard (e.g. from a strike with a basketball) can be translated to the housing 204 and the vibration sensor.

Figure 5B:
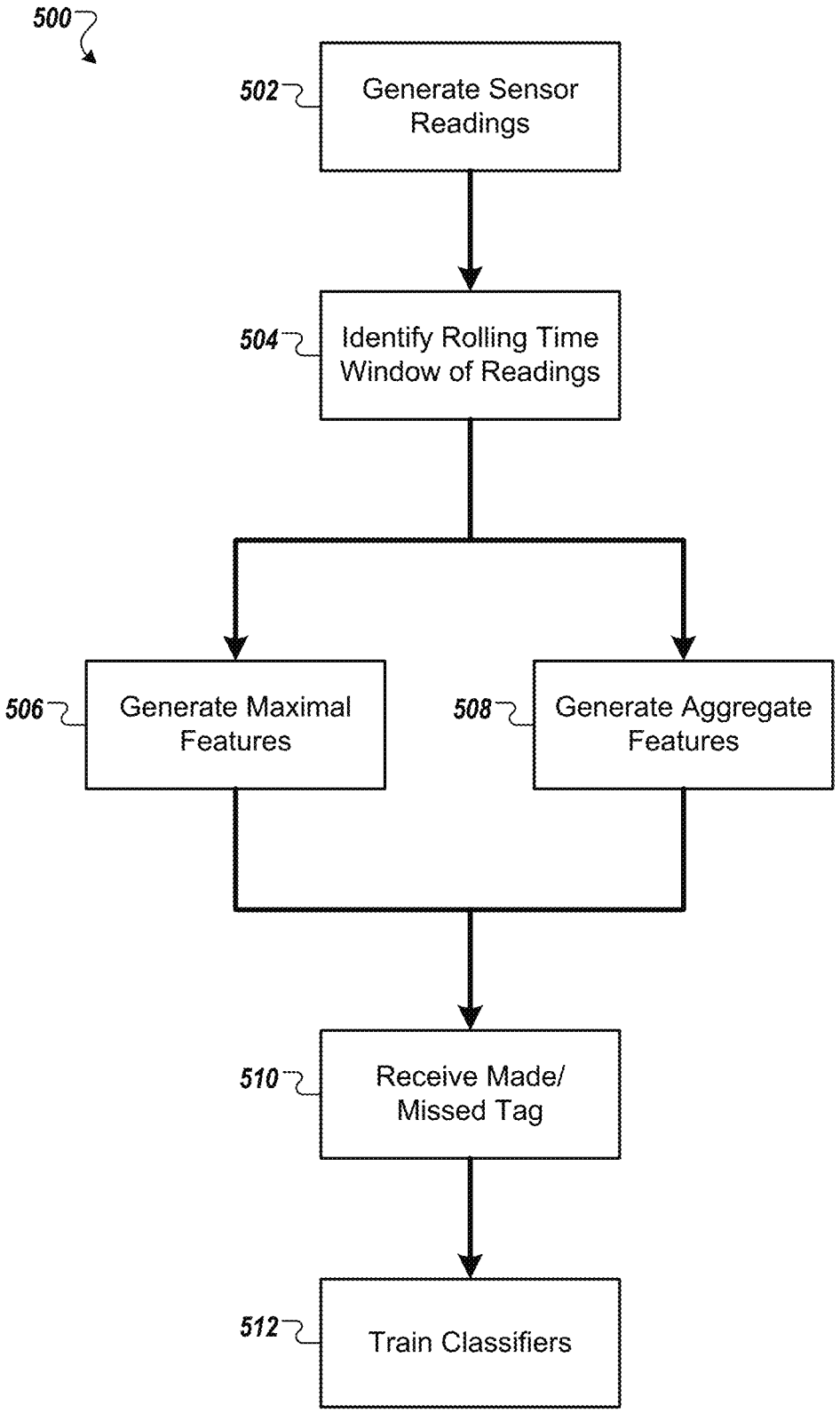
FIG. 5 is a flowchart of an example process for training a made-classifier for use in a made-sensing device.

FIG. 5 is a flowchart of an example process 500 for training a made-classifier for use in a made-sensing device. The process 500 can be used, for example, with one or more of the devices 102 and other computer systems in order to train one or more made-classifiers that are able to classify a window of readings from a datastream of a vibration sensor. That is, the made-classifiers can be used to determine if a sensor datastream indicates a made shot or a missed shot of a basketball into a hoop having a device 102 attached.

In order to perform the process 500, a user (i.e. a human user such as a player or coach) can attach the device 102 to a portion of a basketball goal, such as to a basketball hoop, to a basketball backboard, or to a bracket/bracer that connects the basketball hoop to the basketball backboard. Then, the user can take a predefined number of shots on the hoop, or can take shots until a predefined number of makes and misses are taken. These makes and misses can be recorded for later use as training tags. The user can then access the sensor readings generated and stored in the device 102 and tag the sensor readings with the makes and misses.

Sensor readings are generated 502. For example, the user can shoot a basketball at the hoop, making some shots and missing some other shots.

For some shots, the ball impacts the impact member 202, creating vibrations in the impact member 202. These vibrations are communicated to the primary housing 204 that is being sensed by the vibration sensor. In some shots, including some shots that do not impact the impact member 202, the ball impacts the primary housing 204 and creates vibrations in the primary housing 204 that is being sensed by the vibration sensor. As will be understood, it may be possible for a made shot (i.e. a shot going through the hoop) to impact with only the hoop, only the net, only the backboard only the impact sensor 202, only the primary housing 204, or a combination of two or more of these elements, creating vibrations that are sensed. As will be understood, it may be possible for a missed shot (i.e. a shot that does not go through the hoop) to impact with only the hoop, only the net, only the backboard, only the impact sensor 202, only the primary housing 204, or a combination of two or more of these elements, creating vibrations that are sensed.

A rolling time window of readings is identified 504. For example, the processor can be configured to identify N most recent readings in the datastream from the vibration sensor. In another example, the process can be configured to identify the readings that were generated or received within the last M time unites (e.g., seconds, ms.). In some cases, the vibration sensor may store the sensor readings in an rolling memory buffer that is accessible to the processor. In some cases, the vibration sensor can provide the sensor readings directly to the processor that may or may not store the sensor readings. As time moves forward, the rolling time window moves forward and the processor will continue to work with the N most recent sensor readings or the sensor readings of the last M time units in consecutive operations.

Maximal features are generated 506 and aggregate features are generated 508. For example, the processor can use the sensor readings of the rolling time window to generate one or more values for one or more features. Two possible types of features are described in this example, but it will be understood that other types of features are possible.

Maximal features are a largest change in acceleration in sensor readings, including sequential sensor readings. For example, if the processor is using 25 sensor readings, the processor may find an X-max, a Y-max, and a Z-max value. The X-max value may be the largest change in X-value from one sensor reading to the next. Similarly, the Y-max value may be the largest change in Y-value and Z-value, respectively, from one sensor reading to the next. This value may be operated on before used. For example, it may be scaled (e.g., from 0 to 1,) have only the magnitude taken to remove the possibility of a negative value, squared or have the square-root found, etc. Other example maximal readings could include the largest difference between any two sensor readings including of non-adjacent readings.

The aggregate feature is a summation of every change in acceleration in sequential readings. For example, if the processor is using 25 sensor readings, the processor may find an X-change, a Y-change, and a Z-change that records the magnitude of change for the X-value, Y-value, and Z-value from each sensor reading to the next. It will be understood that, as a magnitude, this may be restricted to only positive values in some configurations. Then, these magnitudes may be aggregated to find an X-totalChange, a Y-totalChange, and a Z-totalChange. This aggregation may be a simple addition or a different process such as a sum-of-squares in which each magnitude is squared before addition, an addition that excludes the single largest magnitude in each direction, etc.

Made/missed tags are received 510. For example, the features for the shots may be transferred from the device 102 to a computer device and paired with tags for the shots taken. In one example, the tags for the shots taken have a Boolean value recording the make/miss result and also have a timestamp specifying the time the shot was taken. Timestamps of the features may be used to identify corresponding sensor readings and this pairing can be recorded in computer memory.

Classifiers are trained 512. For example, a machine-learning process can be used to generate one or more classifiers from the sensor readings and corresponding made/missed tags. In some cases, the machine-learning process can include a supervised learning algorithm where the algorithm builds a data model that correlates the classifier values to the provided made/missed tags. This kind of classification model can produce, for example, classifiers that, generally speaking, i) receive new sensor readings, ii) apply mathematical processes (e.g., multiply by coefficients, combine values,) and produce a confidence score. This confidence score can be used as likelihood that the set of recent sensor readings correspond to a made attempt in the sporting activity. Other alternatives are possible. For example, instead of generating features and training the classifiers on the feature data, classifiers can be trained directly on the raw or cleaned sensor data. For example, a hidden neural network can be trained on the raw sensor data or on any sensor data that is within a band-pass filter that is calibrated to exclude anomalous results.

In some configurations, this type of classifier training can be particularly accurate due to the particular interactions of the physical elements of the system 100 (e.g., the ball 106, the device 102, and the hoop 104). When a shot is attempted but does not go through the hoop 104, the ball 106 does not or rarely contacts the impact member 202 if the impact member 202 is positioned in a path of made shots (e.g. under the hoop 104). Accordingly, when the device 102 senses vibrations caused by impact with the impact member 202, this can increase the confidence in the device 102 that the sensed vibrations were caused by a made shot.

In some embodiments, the classifiers can be trained by the device 102 itself, and then later used by the device 102 to distinguish between made and missed shots. In some embodiments, the classifiers can be trained by another device or system, and then the device 102 can be programmed with the classifiers and used to distinguish between made and missed shots.

FIG. 6A is a swimlane diagram of an example process 600 for determining made-attempts with a made-sensing device. In the process 600, the device 102 is being used to automatically track and update player statistics related to makes and misses. For example, as the player takes shots, the device 102 determines if the shot is a make or a miss based on automatic classifications of sensor data and those determinations are compiled into statistics for the user. As such, the process 600 can be used to determine if a basketball shot was attempted and successfully went through the basketball hoop or if the ball did not go through the basketball hoop.

The device 102 being described can include a housing 204 as well as a circuit board 206. The circuit board can includes one or more sensors 602, a processor 604, a computer memory 606, and a transmitter 608. The device 102 can communicate with a client device 610.

The sensors 602 can include an accelerometer and/or other sensor(s) able to sense vibrations in the housing 204. The processor 604 includes one or more devices capable of executing computer instructions. These instructions may be stored directly on the processor 604, stored in the computer memory 606, etc. The computer memory 606 can store data, for example in registers that are addressable and accessible by the processor 604. The transmitter 608 can include wired or wireless interfaces for transmitting data. This can include, but is not limited to, a Bluetooth interface, a Wi-Fi interface, a ZigBee interface, a Universal Serial Bus (USB) interface, etc. The client device 610 can include one or more computing devices that can communicate with the device 102 but that are not the device 102. This can include, for example, a mobile device (e.g., a phone or tablet,) a computer (e.g., a laptop or a server), a basketball passing device, or another device. The client device 610 may include, or may have access to, user interfaces elements such as a screen, buttons, a touchscreen, etc.

The housing 204 vibrates from contact with the ball 612. For example, a player can shoot a basketball to a hoop that has the device 102 attached. In other examples, a player can shoot a hockey puck at a net with a device 102 attached, kick a ball to a net having a device 102 attached, throw a ball to a goal or target with a device 102 attached, etc. As will be understood, the device 102 can take different shapes to accommodate different types of goals used for different sporting events. However, this example will be described in the context of basketball.

When the shooter shoots the ball, either as a make or as a miss, and contacts the rim, backboard, device 102, etc., the contact creates a vibration. If the contact is with the housing 204 directly, the vibration is communicated from the housing 204 to the sensors 602. If the contact is with a different element of the device 102 (e.g. the impact member 202), the vibration is communicated to the housing 204 and thus to the sensors 602. If the contact is with the hoop, backboard, etc., the vibration is communicated to the housing 204 and thus to the sensors 602.

The sensors 602 sense the vibrations 614. For example, as the sensors 602 can be mechanically coupled to the housing 204 and can sense the vibration of the housing 204. The sensors 602 can generate one or more datastreams that record the vibrations of the housing 204. For example, a datastream may record, at a point in time, one or more parameter of the vibration. This can include a measure of displacement, acceleration, orientation, deformation, etc. A datastream may record data in one dimension (e.g., a single value to represent deformation, a single value to represent distance traveled in 3D space) or in multiple directions (e.g., an X-value, a Y-value, and a Z-value.)

The processor 604 receives the readings 616. For example, the sensors 602 may influence a voltage on a lead in a circuit board according to binary representation of data in the datastream. The processor 604 may also be connected to that lead and may monitor the voltage on that lead. The processor 604 can convert this voltage to, for example, binary data. As such, data (e.g., binary values) generated by the sensors 602 can be received by the processor 604.

The processor 604 stores the readings 618 in the computer memory 606. For example, the computer memory 606 can include a range of registers to be used as a rolling buffer of sensor readings. The processor 604 can store the most recently received reading in the register holding the oldest sensor reading, overwriting the stored oldest reading. In some cases, the process 604 can store an index value that is the address of the register address of the oldest value in the computer memory 606. When a new value is stored, this index value can be increased. If the increase moves the index out of the range of the rolling buffer, the process 604 can set the index to the lowest (or highest) register address in the rolling buffer.

The processor 604 submits recent readings to a classifier 620. In some cases, in order to do so, the processor 604 can generate values for one or more features to be submitted and submit those values to one or more classifiers.

For example, the processor 604 can generate, from the set of recent sensor readings, at maximal feature that represents a maximal measure of the vibrations. This maximal measure may include, for example, the greatest change in one dimension from one register location to the next register location in the memory 606. For example, the processor 604 may compare, for each register in the rolling buffer, an X-value of a register with an X-value of the next register location and select the largest X-value. The processor 640 may repeat this for each cardinal directions X, Y, and Z. In another alternative, the processor 604 may calculate a distance from the XYZ location in one register to the XYZ location in the next register using, for example, a Euclidean distance function and select the largest value as the maximal feature.

For example, the processor 604 can generate, from the set of recent sensor readings, an aggregate feature that represents an aggregate measure of the vibrations. This aggregate feature may include, for example, a summation of changes in location in one dimension from one register location to the next register location in the memory 606. For example, the processor 604 may compare, for each register in the rolling buffer, an X-value of a register with an X-value of the next register location to find a displacement value and add this displacement value to a running total of all displacement values in the X direction in the register. The processor 640 may repeat this for each cardinal directions X, Y, and Z. In another alternative, the processor 604 may calculate a distance from the XYZ location in one register to the XYZ location in the next register using, for example, a Euclidean distance function and add this to a rolling total of all displacements in the register.

In another example, the processor 604 can submit the raw recent readings to the classifier. For example, in a case where the classifier is trained using the raw sensor data, the processor 604 can submit some or all of the contents of the rolling buffer of the computer memory 606 to the classifier.

After submitting the recent readings to the classifier, the classifier operates on the recent readings to produce a made-confidence and supplies the made-confidence to the processor 604 for further use. The made-confidence can be used as a measure of a likelihood that the set of recent sensor readings correspond to a made attempt in the sporting activity. That is to say, a low made-confidence may indicate a low likelihood that the most recent attempt was a make, while a high made-confidence may indicate a high likelihood that the most recent attempt was a make.

The process 604 determines make or miss 624. For example, the processor 602 can compare the made-confidence against a made-threshold value that indicates a minimum likelihood for an attempt to be considered made. So, for a threshold value T and a confidence C, if C<T, then the processor 604 can determine that the most recent readings indicate a miss. If C>T, then the processor 604 can determine that the most recent readings indicate a made shot.

By way of example, consider two attempts. In the first attempt, a shot is taken that contacts the rim and primary housing 204 only but does not go through the hoop. This attempt generates a vibrations based on contact with the rim or primary housing 204. In another attempt, a shot is taken that contacts the rim and the impact member 202. Because the impact member 202 is in vibrational communication but not completely-perfect rigid coupling with the primary housing 202, the second, made, shot generates a very different set of vibrations. The difference between these vibrations are large enough to be detected a vibration sensor that is included in the device 102, and thus used as the basis for training of classifiers.

If the attempt is a make 626, the transmitter 608 transmits the make information 628 and the client device receives the make information 632. For example, the processor 604 can generate a made-message indicating that the shot was made. This can include, for example, a time stamp and other relevant metadata. The processor 606 can use the transmitter 608 to transmit the made-message to the client device 610.

The client device 610 receives a shot count 630 and can receive the made-message 632. For example, the client device 610 may be a ball-throwing device that counts the number of balls thrown to a player to take shots with. The ball-throwing device may send, to the client device 610, a message with a count of balls thrown or a message for each ball thrown. In another example, the client device 610 may itself be a ball-throwing device and can receive 630 the shot count from memory.

The client device 610 displays automated statistics 634. For example, the client device 610 can keep a running tally of shots attempted and made and display them to the player as the player is taking the shots. In another example, the client device can gather the shot count 630 and made-messages 632 in order to display the player statics to another user (e.g., a coach) and/or at another time (e.g., after practice).

FIG. 6B is a swimlane diagram of an example process 650 for determining made-attempts with a made-sensing device. In the process 600, the device 102 is being used to automatically track and update player statistics related to makes and misses. For example, as the player takes shots, the device 102 determines if the shot is a make or a miss based on automatic classifications of sensor data and those determinations are compiled into statistics for the user. As such, the process 60 can be used to determine if a basketball shot was attempted and successfully went through the basketball hoop or if the ball did not go through the basketball hoop.

In the process 650, the processor uses the transmitter 608 to transmit 652 the readings to the client device 610. From that point, the client device 610 is able to submit recent readings to a classifier 620, compare confidence values to thresholds 622, and determine makes and misses 624. In this way, the client device 610 instead of the processor 604 can perform some of the computationally-intensive elements of the process 650.

The process 600 and the process 650 may be used as two different possible configurations for generally-similar hardware. For example, the hardware can include a hardware or software toggle to switch between the two processes. In another example, the process 650 can be used to preserve battery power of the device 102, when debugging or developing the software for the device 102, or when greater data-logging is useful. In some situations, the process 600 and 650 may be performed simultaneously.

FIG. 7 shows an example of a computing device 700 and an example of a mobile computing device that can be used to implement the techniques described here. The computing device 700 is intended to represent various forms of digital computers, such as laptops, desktops, workstations, personal digital assistants, servers, blade servers, mainframes, and other appropriate computers. The mobile computing device is intended to represent various forms of mobile devices, such as personal digital assistants, cellular telephones, smart-phones, and other similar computing devices. The components shown here, their connections and relationships, and their functions, are meant to be exemplary only, and are not meant to limit implementations of the inventions described and/or claimed in this document.

The computing device 700 includes a processor 702, a memory 704, a storage device 706, a high-speed interface 708 connecting to the memory 704 and multiple high-speed expansion ports 710, and a low-speed interface 712 connecting to a low-speed expansion port 714 and the storage device 706. Each of the processor 702, the memory 704, the storage device 706, the high-speed interface 708, the high-speed expansion ports 710, and the low-speed interface 712, are interconnected using various busses, and may be mounted on a common motherboard or in other manners as appropriate. The processor 702 can process instructions for execution within the computing device 700, including instructions stored in the memory 704 or on the storage device 706 to display graphical information for a GUI on an external input/output device, such as a display 716 coupled to the high-speed interface 708. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 704 stores information within the computing device 700. In some implementations, the memory 704 is a volatile memory unit or units. In some implementations, the memory 704 is a non-volatile memory unit or units. The memory 704 may also be another form of computer-readable medium, such as a magnetic or optical disk.

The storage device 706 is capable of providing mass storage for the computing device 700. In some implementations, the storage device 706 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The computer program product can also be tangibly embodied in a computer- or machine-readable medium, such as the memory 704, the storage device 706, or memory on the processor 702.

The high-speed interface 708 manages bandwidth-intensive operations for the computing device 700, while the low-speed interface 712 manages lower bandwidth-intensive operations. Such allocation of functions is exemplary only. In some implementations, the high-speed interface 708 is coupled to the memory 704, the display 716 (e.g., through a graphics processor or accelerator), and to the high-speed expansion ports 710, which may accept various expansion cards (not shown). In the implementation, the low-speed interface 712 is coupled to the storage device 706 and the low-speed expansion port 714. The low-speed expansion port 714, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 700 may be implemented in a number of different forms, as shown in the figure. For example, it may be implemented as a standard server 720, or multiple times in a group of such servers. In addition, it may be implemented in a personal computer such as a laptop computer 722. It may also be implemented as part of a rack server system 724. Alternatively, components from the computing device 700 may be combined with other components in a mobile device (not shown), such as a mobile computing device 750. Each of such devices may contain one or more of the computing device 700 and the mobile computing device 750, and an entire system may be made up of multiple computing devices communicating with each other.

The mobile computing device 750 includes a processor 752, a memory 764, an input/output device such as a display 754, a communication interface 766, and a transceiver 768, among other components. The mobile computing device 750 may also be provided with a storage device, such as a micro-drive or other device, to provide additional storage. Each of the processor 752, the memory 764, the display 754, the communication interface 766, and the transceiver 768, are interconnected using various buses, and several of the components may be mounted on a common motherboard or in other manners as appropriate.

The processor 752 can execute instructions within the mobile computing device 750, including instructions stored in the memory 764. The processor 752 may be implemented as a chipset of chips that include separate and multiple analog and digital processors. The processor 752 may provide, for example, for coordination of the other components of the mobile computing device 750, such as control of user interfaces, applications run by the mobile computing device 750, and wireless communication by the mobile computing device 750.

The processor 752 may communicate with a user through a control interface 758 and a display interface 756 coupled to the display 754. The display 754 may be, for example, a TFT (Thin-Film-Transistor Liquid Crystal Display) display or an OLED (Organic Light Emitting Diode) display, or other appropriate display technology. The display interface 756 may comprise appropriate circuitry for driving the display 754 to present graphical and other information to a user. The control interface 758 may receive commands from a user and convert them for submission to the processor 752. In addition, an external interface 762 may provide communication with the processor 752, so as to enable near area communication of the mobile computing device 750 with other devices. The external interface 762 may provide, for example, for wired communication in some implementations, or for wireless communication in other implementations, and multiple interfaces may also be used.

The memory 764 stores information within the mobile computing device 750. The memory 764 can be implemented as one or more of a computer-readable medium or media, a volatile memory unit or units, or a non-volatile memory unit or units. An expansion memory 774 may also be provided and connected to the mobile computing device 750 through an expansion interface 772, which may include, for example, a SIMM (Single In Line Memory Module) card interface. The expansion memory 774 may provide extra storage space for the mobile computing device 750, or may also store applications or other information for the mobile computing device 750. Specifically, the expansion memory 774 may include instructions to carry out or supplement the processes described above, and may include secure information also. Thus, for example, the expansion memory 774 may be provide as a security module for the mobile computing device 750, and may be programmed with instructions that permit secure use of the mobile computing device 750. In addition, secure applications may be provided via the SIMM cards, along with additional information, such as placing identifying information on the SIMM card in a non-hackable manner.

The memory may include, for example, flash memory and/or NVRAM memory (non-volatile random access memory), as discussed below. In some implementations, a computer program product is tangibly embodied in an information carrier. The computer program product contains instructions that, when executed, perform one or more methods, such as those described above. The computer program product can be a computer- or machine-readable medium, such as the memory 764, the expansion memory 774, or memory on the processor 752. In some implementations, the computer program product can be received in a propagated signal, for example, over the transceiver 768 or the external interface 762.

The mobile computing device 750 may communicate wirelessly through the communication interface 766, which may include digital signal processing circuitry where necessary. The communication interface 766 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 768 using a radio-frequency. In addition, short-range communication may occur, such as using a Bluetooth, WiFi, or other such transceiver (not shown). In addition, a GPS (Global Positioning System) receiver module 770 may provide additional navigation- and location-related wireless data to the mobile computing device 750, which may be used as appropriate by applications running on the mobile computing device 750.

The mobile computing device 750 may also communicate audibly using an audio codec 760, which may receive spoken information from a user and convert it to usable digital information. The audio codec 760 may likewise generate audible sound for a user, such as through a speaker, e.g., in a handset of the mobile computing device 750. Such sound may include sound from voice telephone calls, may include recorded sound (e.g., voice messages, music files, etc.) and may also include sound generated by applications operating on the mobile computing device 750.

The mobile computing device 750 may be implemented in a number of different forms, as shown in the figure. For example, it may be implemented as a cellular telephone 780. It may also be implemented as part of a smart-phone 782, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

Modifications to the described examples are understood to be within the scope of the technology described here. Such modifications include, but are not limited to, replacement of some elements, the incorporation of this technology into other systems, and the like.

What is claimed is:

1. A basketball shot counter system comprising:

a mounting shaped and sized to connect the basketball shot counter system to a portion of a basketball goal having a basketball hoop;

a vibration sensor; and a processor in data communication with the vibration sensor, wherein the processor is configured to:

receive, from the vibration sensor, a datastream of vibration sensor readings;

determine, from the datastream of vibration sensor readings, that a first basketball shot was attempted without successfully going through the basketball hoop;

determine, from the datastream of vibration sensor readings, that a second basketball shot was attempted and successfully went through the basketball hoop; and responsive to the determination that the second basketball shot was attempted and successfully went through the basketball hoop, transmit to a client device a made-message indicating that the second basketball shot was attempted and successfully went through the basketball hoop, wherein, to determine, based on a set of recent sensor readings, that the second basketball shot was attempted and successfully went through the basketball hoop, the processor is configured to:

submit the set of recent sensor readings to a made-classifier;

receive, from the made-classifier, a made-confidence that measures a likelihood that the set of recent sensor readings correspond to a made basketball shot; and compare the made-confidence against a made-threshold value that indicates a minimum likelihood for the second basketball shot to be considered made.

2. The basketball shot counter system of claim 1, wherein the processor is configured to distinguish vibration sensor readings indicative of a made shot from vibration sensor readings indicative of a missed shot.

3. The basketball shot counter system of claim 1, wherein the processor is configured to distinguish vibration sensor readings indicative of a made shot from vibration sensor readings indicative of a missed shot based on a predictive model that is configured to predict whether a shot is made based upon one or more machine-learning trained classifiers and the datastream of vibration sensor readings.

4. The basketball shot counter system of claim 1, wherein the vibration sensor comprises an accelerometer, and wherein the basketball shot counter system further comprises a magnetometer and a gyroscope.

5. The basketball shot counter of system claim 1, wherein the datastream comprises a first set of vibration data and a second set of vibration data, wherein the processor is configured to interpret the first set of vibration data as being indicative of a missed shot when the first set of vibration data appears without the second set of vibration data and the processor is configured to interpret the first set of vibration data as being indicative of a made shot when the first set of vibration data appears with the second set of vibration data.

6. The basketball shot counter system of claim 1, wherein the basketball shot counter system comprises an impact member in vibrational communication with the vibration sensor, wherein the impact member is sized and configured to be positioned in a ball path under the basketball hoop when the basketball shot counter system is mounted to the basketball goal.

7. The basketball shot counter system of claim 1, wherein the basketball goal further comprises a backboard and a net, and wherein the basketball shot counter system is configured to transfer vibration from the basketball goal to the vibration sensor when a basketball impacts the backboard and when the basketball impacts the basketball hoop.

8. The basketball shot counter system of claim 1, wherein a single unit comprises the mounting, the vibration sensor, and the processor.

9. The basketball shot counter system of claim 1, wherein the processor is physically remote from the vibration sensor and the mounting and wherein the processor is a part of a client device.

10. A sports shot counter comprising:

a mounting shaped and sized to connect the sports shot counter to a portion of a sports goal;

a sensor configured to sense an impact; and a processor in data communication with the sensor, wherein the processor is configured to sense and distinguish between made shots and missed shots as a function of sensed impact, wherein the sensor is a vibration sensor configured to sense impact with the sports goal and wherein the processor is configured to sense and distinguish between made shots and missed shots as a function vibration caused by impact with the sports goal, and wherein, to submit a set of recent sensor readings to a made-classifier, the processor is configured to:

generate, from the set of recent sensor readings, a maximal feature that represents a maximal measure of the vibrations; and generate, from the set of recent sensor readings, an aggregate feature that represents an aggregate measure of the vibrations.

11. The sports shot counter of claim 10, wherein the processor distinguishes between made shots and missed shots according to a predictive model of trained classifiers.

12. A device for determining made-attempts in a sporting activity, the device comprising:

a primary housing;

a vibration sensor mechanically coupled to the primary housing and configured to sense vibrations of the primary housing;

an impact member in vibrational communication with the primary housing, the impact member comprising a metal spring in a curved tube;

a mounting shaped to interface with a goal usable for the sporting activity in order to attach the device to the goal; and a processor configured to:

receive, from the vibration sensor, a datastream of sensor readings;

identify a set of recent sensor readings;

determine, based on the set of recent sensor readings, if an attempt of the sporting activity was made; and responsive to the determination, transmit to a client device a made-message indicating if the attempt of the sporting activity was made, wherein, to determine, based on the set of recent sensor readings, if the attempt of the sporting activity was made, the processor is configured to:

submit the set of recent sensor readings to a made-classifier;

receive, from the made-classifier, a made-confidence that measures a likelihood that the set of recent sensor readings correspond to a made attempt of the sporting activity; and compare the made-confidence against a made-threshold value that indicates a minimum likelihood for the attempt of the sporting activity to be considered made.

13. The device of claim 12, wherein impact by a basketball with the impact member creates first vibrations in the impact member, and wherein the first vibrations are communicated from the impact member to the primary housing sensed by the vibration sensor.

14. The device of claim 12, wherein impact by a basketball with a basketball hoop that is connected to the primary housing creates second vibrations of the primary housing sensed by the vibration sensor.

15. The device of claim 14, wherein the processor is configured to determine if the attempt of the sporting activity was made based at least in part on the second vibrations.

16. The device of claim 15, wherein the attempt of the sporting activity was made.

17. The device of claim 16, wherein the attempt of the sporting activity was not made.

18. The sports shot counter of claim 10, wherein the maximal feature is a largest change in acceleration in sequential sensor readings in the set of recent sensor readings; and wherein the aggregate feature is a summation of every change in acceleration in sequential sensor readings in the set of recent sensor readings.

19. The sports shot counter of claim 10, wherein:

the vibration sensor is an accelerometer that is configured to sense acceleration in an X-direction, acceleration in a Y-direction, and acceleration in a Z-direction; and each sensor reading in the datastream of sensor readings comprises an X-value corresponding to the sensed acceleration in the X-direction, a Y-value corresponding to the sensed acceleration in the Y-direction, and a Z-value corresponding to the sensed acceleration in the Z-direction.

20. The device of claim 12 wherein, to submit the set of recent sensor readings to a made-classifier, the processor is configured to:

generate, from the set of recent sensor readings, a maximal feature that represents a maximal measure of the vibrations; and generate, from the set of recent sensor readings, an aggregate feature that represents an aggregate measure of the vibrations.

21. The device of claim 20, wherein the maximal feature is a largest change in acceleration in sequential sensor readings in the set of recent sensor readings; and wherein the aggregate feature is a summation of every change in acceleration in sequential sensor readings in the set of recent sensor readings.

22. The device of claim 20, wherein:

the vibration sensor is an accelerometer that is configured to sense acceleration in an X-direction, acceleration in a Y-direction, and acceleration in a Z-direction; and each sensor reading in the datastream of sensor readings comprises an X-value corresponding to the sensed acceleration in the X-direction, a Y-value corresponding to the sensed acceleration in the Y-direction, and a Z-value corresponding to the sensed acceleration in the Z-direction.

* * * * *